United States Patent [19]

Korshunov et al.

[11] 4,022,048

[45] May 10, 1977

[54] MILL FOR ROLLING CONTINUOUS CAST INGOTS

[76] Inventors: Evgeny Alexeevich Korshunov, pereulok Otdelny, 5a, kv. 29; Evgeny Zakharovich Freidenzon, ulitsa Lunacharskogo, 161, kv. 23; Vladimir Arkadievich Tyagunov, ulitsa Mira, 36/7, kv. 3; Mikhail Ivanovich Fedorov, ulitsa Komsomolskaya, 72, kv. 27, all of Sverdlovsk; Alexandr Ivanovich Kalinin, ulitsa Mira, 12, kv. 49, Nizhny Tagil; Konstantin Alexeevich Malikov, ulitsa Komsomolskaya, 59a, kv. 7, Sverdlovsk; Mikhail Iosipovich Arshansky, prospekt Lenina, 23/40, kv. 8, Nizhny Tagil; Igor Nikolaevich Petrov, ulitsa Malysheva, 152b, kv. 30; Evgeny Valentinovich Melnikov, ulitsa Narodnogo, Fronta 56, both of Sverdlovsk, all of U.S.S.R.

[22] Filed: Sept. 29, 1975

[21] Appl. No.: 617,577

Related U.S. Application Data

[62] Division of Ser. No. 422,071, Dec. 5, 1973, Pat. No. 3,939,896.

[52] U.S. Cl. ..... 72/214; 72/224

[51] Int. Cl.[2] ..... B21B 13/18

[58] Field of Search ..... 72/208, 184, 214, 189, 72/193, 249, 224, 245; 164/76

[56] References Cited

UNITED STATES PATENTS

| | | | |
|---|---|---|---|
| 230,125 | 7/1880 | Gear | 72/208 |
| 3,600,913 | 8/1971 | Dorp | 72/208 X |

FOREIGN PATENTS OR APPLICATIONS

| | | | |
|---|---|---|---|
| 925,131 | 4/1947 | France | 164/282 |

*Primary Examiner*—Milton S. Mehr

[57] ABSTRACT

A mill using a movable stand with shaped rolls featuring a working portion, with the reversible rotation of the rolls being limited by an angle encompassing the working roll portion. The rolling of an ingot being cast is effected by carrying the stand with the rotating rolls "forward" and "backward".

2 Claims, 4 Drawing Figures

MILL FOR ROLLING CONTINUOUS CAST INGOTS

Figure 1:
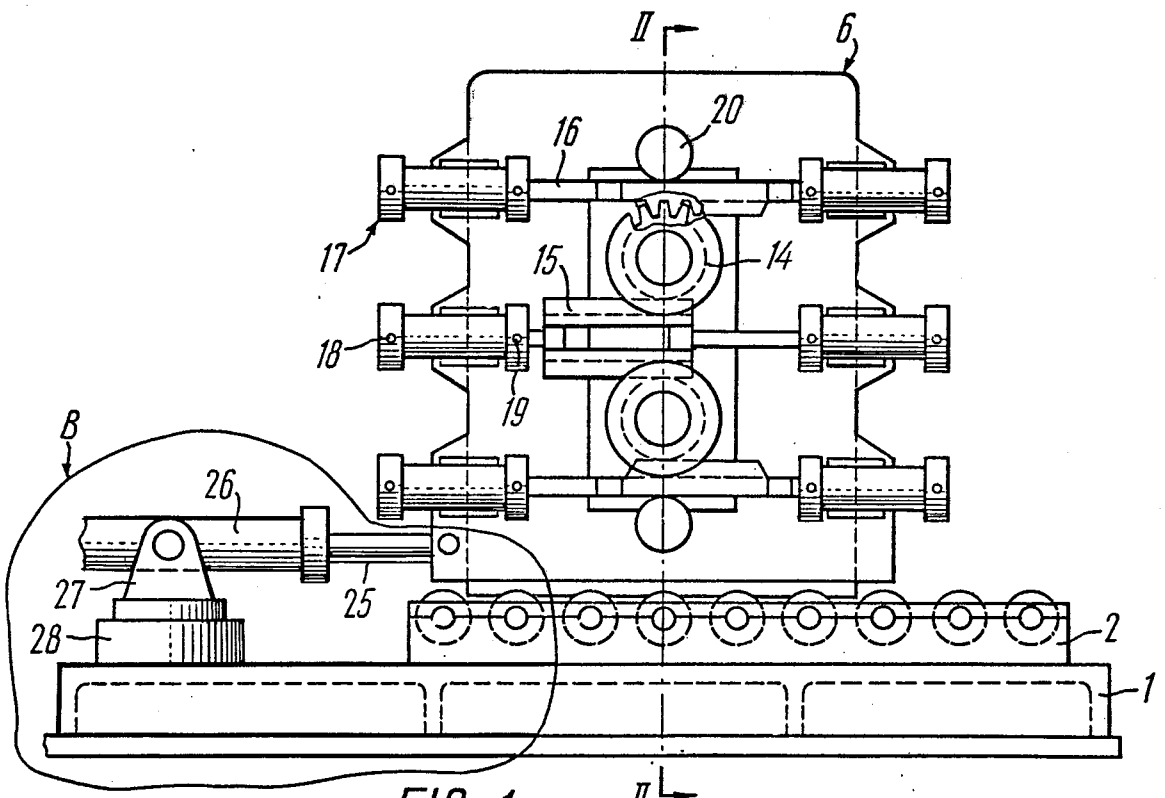

This application is a divisional application of Ser. No. 422,071; filed Dec. 5, 1973, now U.S. Pat. No. 3,939,896.

The present invention relates to the rolling of continuous cast ingots on casting-and-rolling units, referred to hereinafter as rolling casters and, more particularly, to a mill for rolling continuously cast metal ingots withdrawn periodically from a mold.

Known in the art are rolling casters which have been successful in carrying out the combined casting and rolling of a number of non-ferrous metals, aluminum and lead in particular.

The rolling casters for rolling continuous cast steel ingots are also being used on a large scale.

As to the combined processes of continuous casting and rolling of steel, casting machines with radially curved moulds are most frequently utilized for that purpose.

The rolling of ingots on the roller caster is carried out either in several stands, or in a single stand which is adapted for rolling ingots at heavy reductions.

When rolling casters with several mill stands are employed, the rolls in certain stands are often arranged horizontally and in other ones vertically.

Also known is the use of rolling casters comprising specially designed rolling mills, such as planetary or pendulum mills, etc.

The planetary rolling mills comprise one or two pairs of backup rolls of a large diameter around which are arranged work rolls of a small diameter. On such mills the ingot is reduced repeatedly by the work rolls of small diameter during one revolution of the backup roll, the number of such reductions corresponding to that of the work rolls.

The pendulum mills are equipped with the work rolls being mounted in roll-holding means which are actuated by a drive imparting to them a rocking motion about a stationary axle. On this mill the repeated reduction of the ingot being cast is performed during one minute, due to the continuous rocking of the rollholding means together with the rolls, with the ingot being cast also moving continuously.

The shrinkage of the ingot which is being rolled on the mills of the planetary and pendulum types completely satisfies the requirements for the combined casting and rolling process.

One of the advantages of such mills lies in that they are most suitable for the rolling of ingots whose speed of motion is comparable to that of an ingot being cast on modern continuous casting machines.

Also known are mills of the tube cold-rolling mill type, wherein the work shaped rolls are arranged in a movable stand which is imparted a reciprocating motion at a preset distance. In such mills when the movable stand reciprocates, the shaped rolls perform a reversible rotary motion to effect a single reduction of a prescribed section of the strip being rolled during one "forward" - "backward" stroke of the stand.

To enable the next reduction of the ingot during the following "forward" - "backward" stroke of the movable stand, the ingot is displaced at a preset distance.

Insofar as, in the rolling caster, the ingot being cast moves continuously, a mill of the tube cold-rolling mill type may be employed for reducing continuous cast ingots.

However, the above-mentioned known mills of the planetary and pendulum types, as well as those of the tube cold-rolling mill type, are subject to disadvantages.

The planetary and pendulum mills require a sophisticated construction.

In rolling ingots at heavy reductions, the planetary rolling mill can operate only when an ingot being cast is positively fed between its rolls. Hence, a special device with pinch rolls is required for that mill.

All of the three above-mentioned mill types are incapable of operating with the ingot being withdrawn from a mould periodically when the ingot withdrawal time is several times less than a pause between the extractions.

Where the mills are nevertheless adapted for rolling continuous cast ingots moving alternately with standstills, their power requirements would be so great that they would be inefficient economically.

The object of the invention is the provision of a rolling mill which allows rolling and ingot being cast whose movement alternates with standstills.

Still another object of the invention is the provision of a rolling mill which is simple in construction and features a small weight per unit power.

In accordance with the invention, the rolling of continuous cast ingots is performed by withdrawing them periodically from a mold, using a stand with shaped rolls having at least one working section, whose reversible rotation is limited by an angle encompassing the working roll section comprising a shaped section and two cylindrical sections located at the edges of the above section and having different radii — a large one corresponding to a final thickness of an ingot being rolled, and a small one corresponding to the thickness of the ingot being cast.

The shaped section is arcuated so as to provide the prescribed drafting schedule of the ingot portion being rolled. In operating the inventive mill, the following steps are performed: feeding an ingot being cast to a rolling mill; forming an ingot head by reducing it to a final thickness corresponding to the cylindrical section with a large radius of the roll working portion and ensuring the possibility of further rolling the remaining portion of the ingot by progressive repeated reduction between the shaped rolls of the stand which is carried "backward" — against the direction of movement of the ingot, and "forward" — in the direction of movement of the ingot; the rolling of the remaining portion of the ingot being cast with the stand with the rotating rolls being carried "forward" — "backward", during which strokes the ingot is reduced first by the cylindrical sections of the rolls with the large radii, then by the shaped sections and tempered by the cylindrical sections having the small radii.

According to the invention, in forming the ingot head, before each "backward" — "forward" stroke, the stand together with the shaped rolls enclosed therein is positioned so that during each next working stroke of the stand the shaped portions of its rolls would reduce the ingot only to a certain predetermined degree, whereas in rolling the remaining portion of the ingot the movable stand with the rolls contained therein and set to one of their extreme positions is moved, before the ingot has been reduced by the rolls, in the "backward" with respect to the ingot direction, to a position corresponding to the subsequent preset reduction degree, whereafter upon reducing the ingot between the cylindrical roll portions with large radii and shaped section of the working roll portion and tempering it between the cylindrical sections with small radii the rolls of the movable stand are set to another extreme position and the stand with the rolls being stopped is carried "backward" at a distance which is the function of the assigned reduction during the next "forward" stroke of the stand. Then the stand is carried "forward" and after its work rolls have come out of contact with the rolled ingot, it is displaced "backward" at a distance which is the function of the assigned shrinkage to be obtained during the next "backward" stroke of the stand with the "backward" — "forward" strokes being repeated until the entire portion of the ingot extracted from the mould over the withdrawal period is rolled out, whereafter the movable stand with the standing rolls is carried "forward" at a distance equal to the ingot length extracted from the mould over the withdrawal period. Further, after the next extraction of the ingot being cast from the mould the rolling cycles are repeated after each next extraction of the ingot being cast from the mould to enable the rolling of the remaining portion of the ingot being cast.

The present invention results in rolling continuously cast ingots withdrawn periodically from a mould which makes it possible to effect the rolling of an ingot moving alternately with standstills, with the rolling process being carried out essentially during the standstill which is several times greater in duration than the withdrawal period. This enables a mill of a comparatively small rating and, hence, weight to be utilized for rolling purposes.

The invention provides a rolling mill comprising a stage with guides along which transfers a movable stand mounted thereon and furnished with shaped work rolls and with a gear adapted for reciprocation of the stand and for reversible rotation of the mill rolls. According to the invention, the rolling mill is also equipped with a gear for an idle transfer of the stand, said gear being adapted to provide the stand movement when the work rolls are brought out of contact with the ingot being rolled, with the gear for working reciprocation of the stand and reversible rotation of the rolls being made as hydraulic rams mounted on the movable stand and connected to a working fluid supply source, with their rods being coupled with racks in mesh with gears mounted on roll necks.

The herein-proposed rolling mill is characterized by a rather small weight per unit power.

It is expedient that the stand transfer gear, which is adapted to displace the stand when the work rolls do not interact with the ingot being rolled, be made as a hydraulic ram whose rod is connected to the stand.

It is recommended to use the above gear when the length of the ingot portion extracted over the withdrawal period does not exceed 1 meter.

It is also expedient that the stand transfer gear adapted to carry it when the work rolls do not interact with the ingot being rolled be made as a hydraulic engine fastened to the movable stand with the engine shaft carrying a gear in mesh with a rack mounted on the stage in the direction of rolling by which virture the stand transfer gear may be made more compact, simple, light-weight and convenient in use when the ingot portion extracted over the withdrawal period exceeds 1 meter.

Figure 2:
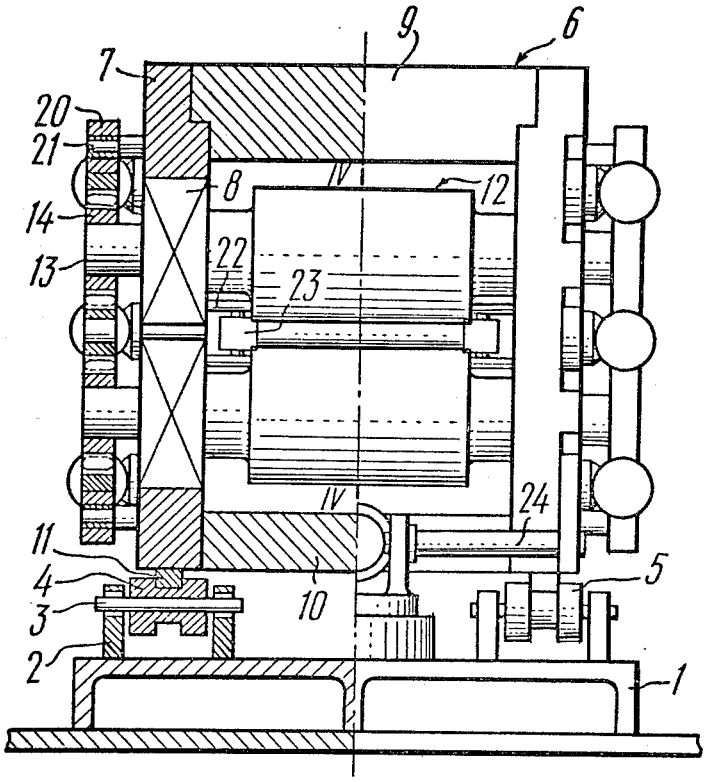
Figure 3:
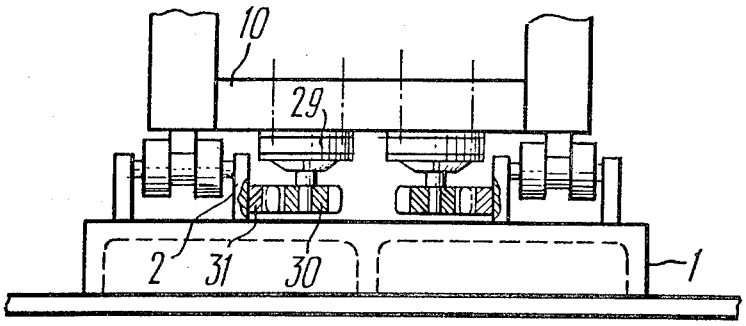
Figure 4:
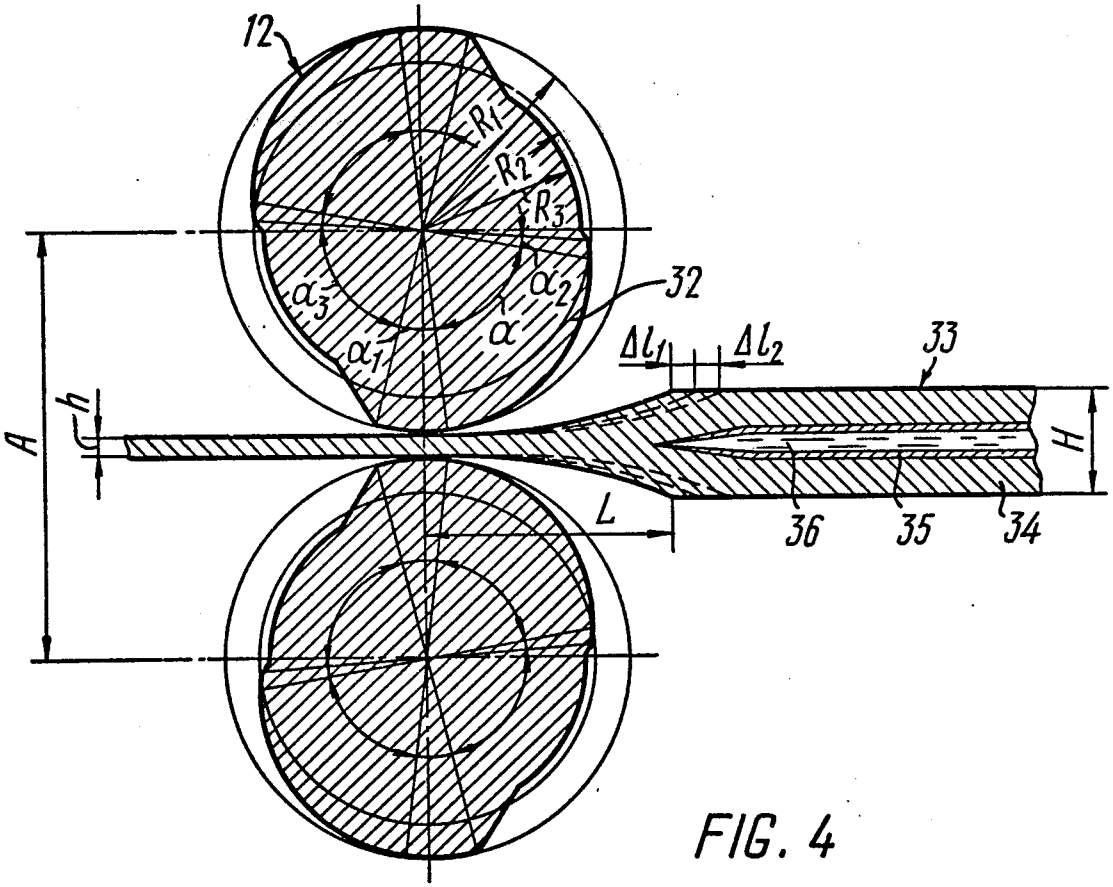

The present invention will be better understood from a consideration of a detailed description of an exemplary embodiment thereof, to be had in conjunction with the accompanying drawings, wherein:

FIG. 1 shows a general view of the rolling mill according to the invention (a side view);

FIG. 2 — section II—II of FIG. 1;

FIG. 3 — is a modification of unit B of FIG. 1 (the gear adapted for an idle transfer of the movable stand with a hydraulic engine) with a fragmentary cutaway along the driving gear and toothed rack;

FIG. 4 — section IV—IV of FIG. 2 (a cross-section along the horizontal shaped rolls and the ingot being rolled).

With reference to FIGS. 1 to 4, the rolling mill embodying the features of the present invention comprises a stationary-mounted stage 1 (FIG. 1). Mounted in parallel to the ingot rolling axis on the stage 1 are two pairs of vertical slideways 2 (FIG. 2) to which shafts 3 having supporting rollers 4 fitted with flanges 5 are fastened.

The mill comprises a movable stand 6 (FIG. 1) with two vertical housings 7 (FIG. 2) whose apertures accommodate chocks 8 arranged in pairs. Intermediate of the vertical housings 7 a top-housing separator 9 and a bottom-mill separator 10 are positioned.

Connected to the bottom part of the housings 7 of the movable stand 6 are guide straps 11 through which the weight of the movable stand is transmitted to the supporting rollers 4 fitted with the flanges 5.

Secured in the chocks 8 are bearings (not shown in the drawing) mounting a pair of work shaped horizontal rolls 12.

The work shaped rolls 12 comprise necks 13 protruding from the outer planes of the housings 7 and carrying gears 14 mounted thereon.

The gears 14 engage toothed racks 15 (FIG. 1) which in turn are coupled with rods 16 of hydraulic rams 17 installed on the housings 7 of the movable stand 6 and connected through openings 18 and 19 by hoses (not shown in the drawing) to a working fluid supply source.

The length of both the hydraulic rams 17 and toothed racks varies with the angle of deflection of the work rolls about their longitudinal axes and with the diameter of a pitch circle of the gear 14.

Potential sagging of the extreme toothed racks 15 is limited by supporting rollers 20 (FIG. 2) mounted so as to allow their rotation about pivots 21 fastened to the housings 7 of the movable stand 6.

On the inner sides of the housings 7 of the movable stand 6 after the horizontal rolls 12, if viewed in the direction of movement of the ingot being cast, are mounted on brackets 22 vertical rolls 23 adapted for tempering side edges of the ingot being rolled.

Intermediate of the housings 7 is articulated beam 24 (FIG. 2) which is connected in its middle portion to a rod 25 (FIG. 1) of a hydraulic ram 26 which serves as a drive adapted for an idle transfer of the movable stand 6. The hydraulic ram 26 is articulated in braces 27 set up on a support 28 fastened to the stage 1.

It is recommended that the hydraulic ram 26 be utilized for an idle transfer of the movable stand 6 in case the mill is designed for a rolling caster wherein the ingots are periodically extracted from a mould with the ingot portion withdrawn from the mould over a withdrawal period not exceeding one meter. If the ingot portion extracted from the mould over the withdrawal period exceeds one meter, it would be reasonable to employ another gear to provide the idle transfer of the movable stand 6.

The gear in question (a modifiction of unit B of FIG. 1) is illustrated in FIG. 3. It comprises hydraulic engines 29 (FIG. 3) anchored at the bottom-mill separator 10 of the movable stand 6 (FIG. 1). The shafts of the hydraulic engines 29 mount gears 30 in mesh with toothed racks 31 attached to the vertical slideways 2 which are mounted stationary on the stage 1.

The work shaped roll 12 (FIG. 4) has two working portions 32 (another number of the working portions may be used being dependent on the possible layout of the working portions on the work roll).

Each working portion 32 of the roll is made up of a shaped section limited by an angle $\alpha$ and arcuated so as to ensure the assigned drafting schedule of an ingot 33 along the length L of its portion being rolled, and two cylindrical sections located at the edges of the shaped section and having different radii — a large one equal to $R_1$ which corresponds to the final thickness $h$ of the ingot 33 being rolled and is limited by an angle $\alpha$, and a small one equal to $R_2$ and corresponding to the thickness H of the ingot being cast and limited by an angle $\alpha_2$.

The working portions 32 of the rolls are separated by idle sections limited by an angle $\alpha_3$ and arcuated with a radius $R_3$ (the idle portions of the rolls may be not cylindrical).

In case the work rolls 12 have several working portions, to provide their alternate operation it is necessary that after certain working roll portions have operated over the preset time period, other working roll portions be put into operation by turning the rolls, together with the gears 14 (FIG. 2) mounted on their necks 13, with respect to the toothed racks 15 through a certain angle which depends upon the layout of other roll sections on the rolls.

To perform the above operation the toothed racks 15 (FIG. 1) are made so that they are capable of being quickly detached from the gears 14 by disconnecting them (the racks 15) from the rods 16 of the hydraulic rams 17.

The profile of the horizontal rolls 12 (FIG. 4) is calculated in terms of an adopted shrinkage $n$ of an ingot, the length L of its portion being rolled and changes in deformation (draft) of the ingot 33 along the length of its portion being rolled. In this case the requisite strength of the rolls should not be overlooked.

The radii $R_1$ nd $R_2$ are determined in accordance with the adopted shrinkage $n = H/h$.

$$R_1 = A\text{-}h/2;$$
$$R_2 = A\text{-}H/2,$$

where A— the spacing between the centers of the mill rolls.

The strength of metal of the ingot portion being rolled, equal in length to L, is a variable quantity. In order to equalize loads acting on the rolls during the rolling process the radius of the shaped section of the work rolls should vary from $R_1$ to $R_2$ in the zone of angle $\alpha$ not uniformly but according to the alteration of the metal strength in the rolling zone.

It should be noted that the mill is intended essentially for the rolling of a completely solidified ingot being cast, though on certain occasions an ingot with a just solidified core and, hence, with irregular temperature distribution along the ingot section can be fed to the mill or an ingot with a not yet solidified core (as shown in FIG. 4) comprising a solid portion 34, solid-liquid portion 35 and a liquid portion 36 would be supplied.

The shrinkage during rolling depends also upon the displacement of the movable stand at a distance $\Delta 1_1$ or $\Delta 1_2$ prior to the next "backward" or "forward" working stroke after the rolls have been brought out of contact with the metal.

Thus, owing to an assigned change in the radius of the shaped section of the work rolls from $R_1$ to $R_2$ and a possibility to alter the stand displacement $\Delta 1_1$ and $\Delta 1_2$ the rolling process may be carried out taking into account an average speed of movement of the ingot being cast, ingot solidifying conditions, variations in the ingot strength in the zone of the ingot portion being rolled, etc.

When rolling the ingot 33 being cast, the rolling procedure is initiated by feeding the ingot to a roll mill stand.

Further, to provide the possibility of further rolling, an ingot head is formed by reducing it to a final thickness $h$ corresponding to a cylindrical section of the work rolls 12 arcuated with a large radius $R_1$. This is effected by reducing the ingot head progressively and repeatedly between the shaped rolls 12 of the movable stand 6 carried "backward" — against the direction of movement of the ingot, and "forward" — in the direction of movement of the ingot, with both the stand proper and the shaped rolls incorporated therein being positioned, prior to each "backward" and "forward" stroke, so that during each next stroke of the stand the shaped sections of the rolls would provide only the specified reduction of the ingot.

Following that the remaining portion of the ingot being cast is to be rolled, the rolling process being started by carrying the stand "backward".

But before the stand has been carried "backward", the work rolls 12 are set with the help of the hydraulic rams 17 to one of their extreme positions which makes it possible to commence the reduction of the ingot between the cylindrical sections of the work rolls arcuated with a large radius $R_1$.

When the rolls are set to the above-mentioned extreme position, they are brought out of contact with the rolled portion of the ingot. This creates the requisite conditions for an idle transfer of the movable stand to be set to a strictly definite, with respect to the ingot, being rolled, position. The shrinkage or reduction of the ingot portion to be rolled during the next working "backward" stroke of the stand would depend upon the position of the movable stand in relation to the ingot being rolled.

Upon carrying the movable stand 6 with the help of the hydraulic ram 26 (FIG. 1) or hydraulic engines 29 (FIG. 3) to the assigned with respect to the ingot position the work rolls are brought into rotation with the aid of the hydraulic rams 17 and after a small idle run commence to reduce the ingot with the stand being carried in this case "backward".

During the "backward" working stroke of the stand the ingot portion being rolled is first tempered and cogged (reduced) between the cylindrical sections of the rolls with a large radius, then it is reduced between the shaped sections of the work rolls, with the working stroke of the stand being completed by tempering the ingot being cast between the roll sections featuring a small radius, during which possible slight bulging of the ingot being cast is eliminated.

Next the work rolls of the movable stand of the mill are brought out of contact with the ingot and set to another extreme position and the stand with the standing rolls keeps moving "backward" with the help of the hydraulic ram 26 or hydraulic engines 29 at a distance equal to $\Delta 1_2$ which is the function of the assigned shrinkage to be obtained during the next "forward" working stroke of the stand.

After that, the work rolls of the movable stand are reversed by the hydraulic rams 17 until they grip the ingot, whereupon the movable stand 6 is carried "forward" and the ingot is first tempered between the cylindrical sections with a small radius $R_2$ provided on the working portions of the rolls, then it is reduced by the shaped roll sections and finally by the cylindrical sections with a large radius $R_1$ of the working roll portions. When the ingot is being reduced between the cylindrical sections featuring a large radius with the stand carried "forward", an ingot portion resulting from its extension (drafting) during two "backward" — "forward" stand strokes is rolled.

Further, after the rolls have come out of contact with the ingot with the work rolls in their extreme position, the movable stand is displaced into its "backward" position at a distance $\Delta 1_1$, the "backward" — "forward" stand strokes being repeated until an ingot length withdrawn from the mould over the withdrawal period is rolled out.

Next the movable stand with the standing rolls enclosed therein is carried "forward" by the hydraulic ram 26 or hydraulic engines 29 at a distance equal to the length of the ingot extracted from the mould over the withdrawal period.

Further, after the next withdrawal of the igot being cast from the mould the rolling cycles are repeated after each next extraction of the ingot being cast from the mould to enable the rolling of the remaining portion of the ingot being cast.

A distinctive feature of the mill operation is worth noting. It consists in that during the idle stroke the movable stand is carried by a special drive comprising a hydraulic ram 26 or hydraulic engines 29.

As to the working stroke, the movable stand is carried by the main hydraulic ram 17 on account of friction forces originating between the work rolls brought into rotation by said hydraulic rams and the ingot being rolled.

However, at the beginning of the working "backward" — "forward" strokes, when the cylindrical section of the work rolls can skid in relation to the ingot being cast, the hydraulic ram 26 or hydraulic engines 29 aid the movement of the movable stand until the ingot being rolled is reliably gripped by the work rolls.

We claim:

1. A mill for rolling continuous cast ingots whose movements alternate with standstills, the mill comprising: a movable stand made up of two housings, intermediate of which a top housing and bottom-mill separators are secured; bearing chocks rigidly fixed in said housing; work-shaped horizontal rolls mounted in said chocks on bearings and featuring in their cross-sections at least one working portion with three sections — a shaped section arcuated so as to provide preset reduction along the length of the ingot being rolled, and two cylindrical sections at the edges of said shaped section, one of said cylindrical sections having a larger radius than the other, the thickness of said one cylindrical section corresponding to that of the rolled ingot and that of said other cylindrical section to the thickness of the ingot being cast, said rolls being furnished with gears mounted stationary at the edges of said rolls; drives for said rolls, constituting hydraulic rams coupled with a working-fluid supply source and fastened to said housings, with rods of said rams being connected to toothed racks that mesh with said gears; two vertical rolls set up on said housings on their inner sides behind said horizontal rolls when viewed in the direction of the movement of the rolled ingot, and adapted for tempering the side edges of the ingot being rolled; guide straps anchored at a bottom portion of said housings; a stage on which said stand is arranged; guides installed on said stage and made in the form of two pairs of vertical slideways with pivots mounting flanged supporting rollers, between which latter said guide straps transfer; a gear for idle transfer of said stand, during which transfer said horizontal rolls do not contact the ingot being rolled; said last-named gear being made as an idle stroke hydraulic ram mounted on said stage and coupled through a rod thereof with said stand; so that the latter is displaced by said drives of the horizontal rolls during the working stroke on account of frictional forces originating between said horizontal rolls that are brought into rotation by said hydraulic rams thereof, and the ingot being rolled, whereas the idle transfer of said stand is performed with the help of said idle-stroke hydraulic ram.

2. A mill for rolling continuous cast ingots whose movements alternate with standstills, the mill comprising: a movable stand made up of two housings, intermediate of which a top housing and bottom-mill separators are secured; bearing chocks rigidly fixed in said housing; work-shaped horizontal rolls mounted in said chocks on bearings and featuring in their cross-sections at least one working portion with three sections — a shaped section arcuated so as to provide preset reduction along the length of the ingot being rolled, and two cylindrical sections at the edges of said shaped section, one of said cylindrical sections having a larger radius than the other, the thickness of said one cylindrical section corresponding to that of the rolled ingot and that of said other cylindrical section to the thickness of the ingot being cast, said rolls being furnished with gears mounted stationary at the edges of said rolls; drives for said rolls, constituting hydraulic rams coupled with a working-fluid supply source and fastened to said housings, with rods of said rams being connected to toothed racks that mesh with said gears; two vertical rolls set up on said housings on their inner sides behind said horizontal rolls when viewed in the direction of the movement of the rolled ingot, and adapted for tempering the side edges of the ingot being rolled; guide straps anchored at a bottom portion of said housings; a stage on which said stand is arranged; guides installed on said stage and made in the form of two pairs of vertical slideways with pivots mounting flanged supporting rollers, between which latter said guide straps transfer; a gear for idle transfer of said stand, during which transfer said horizontal rolls do not contact the ingot being rolled; said last-named gear being made in the form of hydraulic engines fastened to said stand; shafts of said engine carrying gears secured to them and being in mesh with racks set up on said stage in the rolling direction; so that said movable stand is displaced by said drives of the horizontal rolls during the working stroke on account of frictional forces originating between said horizontal rolls that are brought into rotation by said hydraulic rams thereof, and the ingot being rolled, whereas the idle transfer of said stand is performed with the help of said idle-stroke hydraulic engines.

* * * * *